US006147448A

United States Patent [19]

Huang

[11] Patent Number: 6,147,448

[45] Date of Patent: Nov. 14, 2000

[54] PIEZOLELECTRIC PORCELAIN STEP-UP DISCHARGE TUBE

[76] Inventor: Hsien-Jung Huang, P.O. Box 82-144, Taipei, Taiwan

[21] Appl. No.: 09/113,970

[22] Filed: Jul. 13, 1998

[51] Int. Cl.[7] ..... H01J 1/62

[52] U.S. Cl. ..... 313/491; 313/631

[58] Field of Search ..... 313/491, 492, 313/495, 497, 311, 508, 631

[56] References Cited

U.S. PATENT DOCUMENTS 4,404,029 9/1983 Iwaya et al. ..... 501/139

*Primary Examiner*—Michael H. Day
*Assistant Examiner*—Todd Reed Hopper
*Attorney, Agent, or Firm*—A & J

[57] ABSTRACT

A piezoelectric porcelain step-up discharge tube includes a vacuum tube having an inner surface coated with fluorescent material and filled with a substance which can be easily activated to discharge, an input plug mounted on one end of the vacuum tube, a conducting terminal arranged on another end of the vacuum tube, a porcelain step-up device arranged within the vacuum tube and having an end electrically connected with the input plug and another end made of piezoelectric material for providing a discharging electrode for supplying a starting and working voltage, and a conductive material coated on an outer side of the vacuum tube and electrically connecting the input plug to the conducting terminal.

6 Claims, 4 Drawing Sheets

PIEZOLELECTRIC PORCELAIN STEP-UP DISCHARGE TUBE

BACKGROUND OF THE INVENTION

1. Field of the Invention

This invention is related to a discharge tube and in particular to one which utilizes piezoelectric material to provide required voltage for the discharge tube.

2. Description of the Prior Art

The conventional fluorescent lamp is a mercury-vapor electric-discharge lamp having the inside of the bulb or tube coated with fluorescent material so that ultraviolet radiation from the discharge is converted to light of an acceptable color. As shown in FIG. 1, the fluorescent lamp includes an elongated tube 1 which is filled with mercury-vapor and a small amount of argon and coated with fluorescent material 2 on the inner surface. Both ends of the elongated tube 1 are each provided with a filament 3 which is coated with calcium oxide or barium oxide for increasing its emission capability. The filament 3 is also used as the electrode. The elongated tube 1 is provided with two plugs 4 at two ends thereof. As the filaments at two ends of the elongated tube 1 are applied with a high voltage, the cathode will emit a large amount of electrons toward the anode and the electrons will collide with the gas atoms thereby ionizing the gas atoms and releasing a large amount of electrons. As the speed of the electrons moving toward the anode exceeds a certain value, discharge will take place, causing the mercury-vapor to emit ultraviolet light which will be converted to visible light by the fluorescent material 2.

In order to ionize the gas to discharge, a high voltage must be applied to both ends of the fluorescent lamp and so a starting device, ballast and a starter are required for supplying current to the filaments so as to emit a large amount of free electrons, producing a momentary high voltage to activate electrons to move at a high speed, and lowering the voltage applied to both ends of the fluorescent lamp and cutting off the current supplying thereto when discharge takes place. For causing the filaments to emit a large amount of electrons, the filaments must be sufficiently heated and so the filaments must be supplied with current by a push-button device or a starting device. A higher voltage is required to speed up electrons and ionize mercury molecules when starting, and the discharge can be maintained by a lower voltage. A ballast is usually used for accomplishing the demands of voltage variations in starting and use.

However, the conventional fluorescent lamp cannot convert all of the electric energy into visible light and a relatively large amount of the electric energy is converted into heat thereby lowering the efficiency to 05.–0.6. In addition, after having used for a certain period of time, the emission substance will be all consumed and both ends of the fluorescent lamp will be blackened thereby ending the service life of the fluorescent lamp.

SUMMARY OF THE INVENTION

This invention is related to a piezoelectric porcelain step-up discharge tube.

It is the primary object of the present invention to provide an improved discharge tube which is low in manufacturing cost.

It is another object of the present invention to provide an improved discharge tube which has a relatively long service life.

It is still another object of the present invention to provide an improved discharge tube which can work steadily.

It is still another object the present invention to provide an improved discharge tube which will not generate frequency and noise interference.

It is a further object of the present invention to provide an improved discharge tube which is easy to control in illumination intensity.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
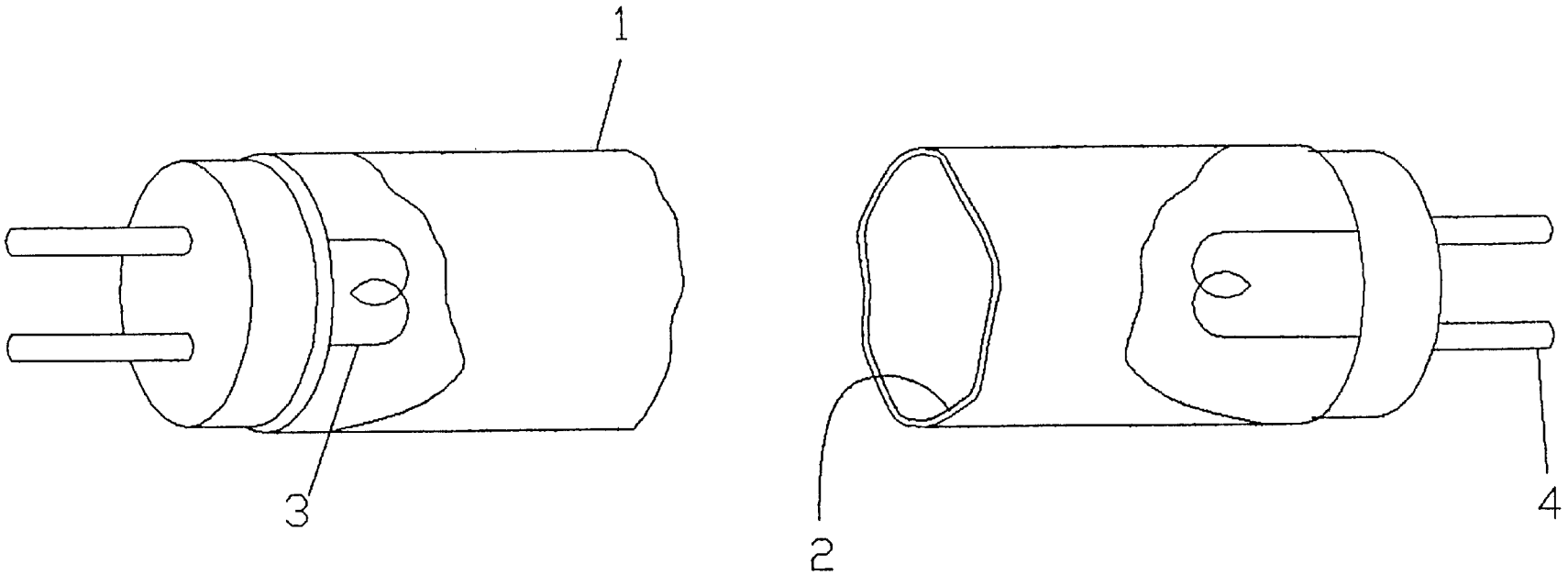
(PRIOR ART) FIG. 1
FIG. 1 illustrates a prior art fluorescent lamp.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
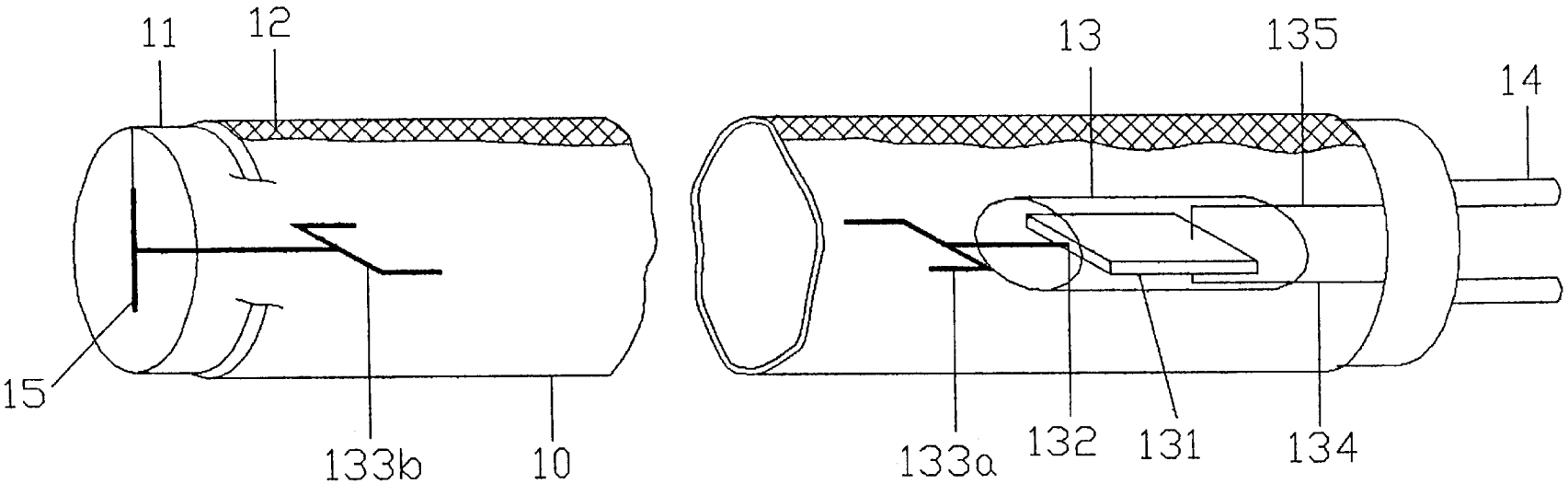
FIG. 2 illustrates the structure of a piezoelectric porcelain step-up discharge tube according to the present invention.
Figure 3B:
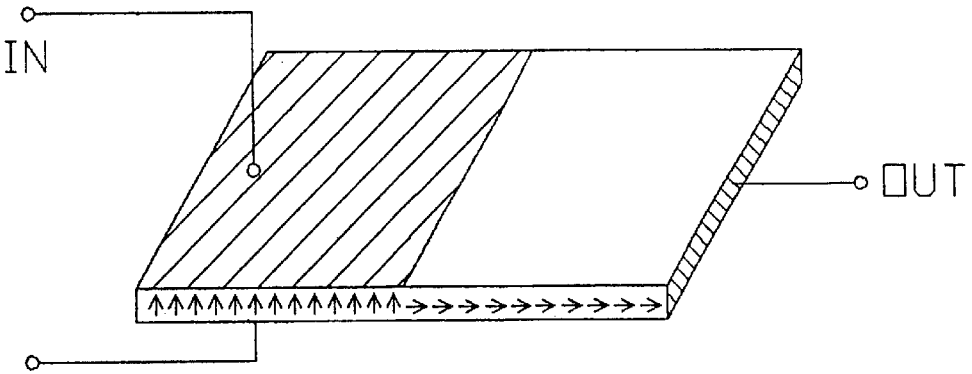
FIG. 3B is a perspective view of the piezoelectric porcelain.
Figure 3A:
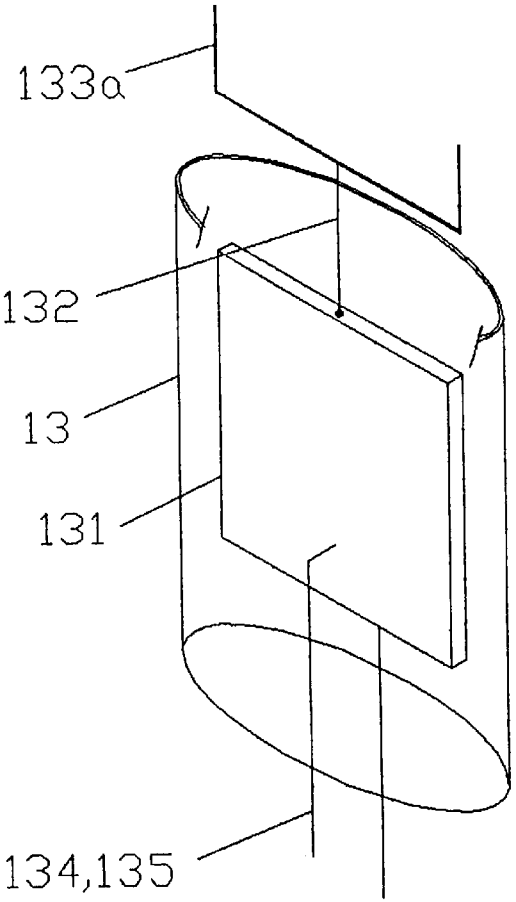
FIG. 3A illustrates the structure of the piezoelectric member.
Figure 4:
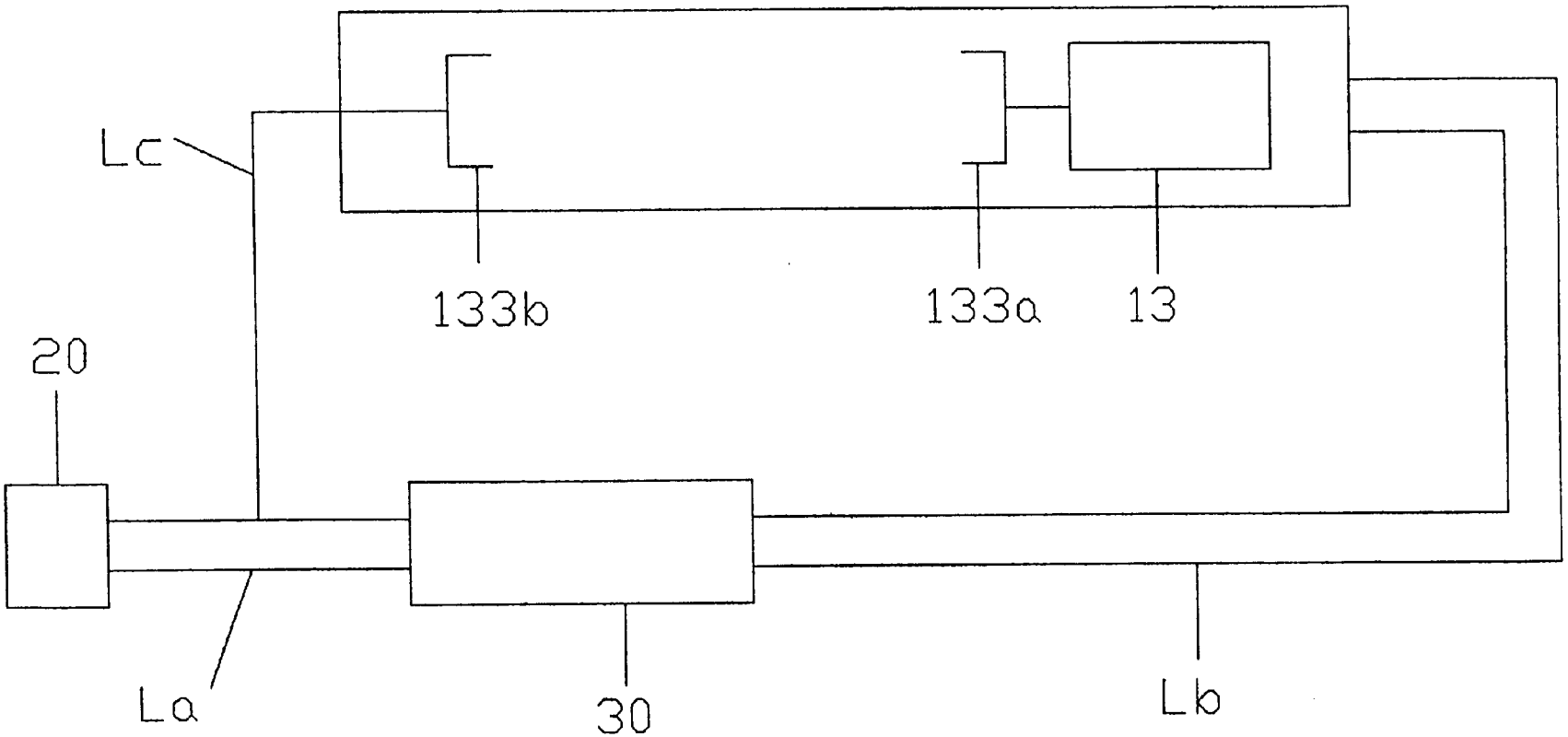
FIG. 4 is a circuit diagram of the present invention.

With reference to the drawings and in particular to FIGS. 2, 3 and 4, the piezoelectric-type porcelain step-up discharge tube 10 according to the present invention generally comprises a tubular member 11 which is first vacuumed and then filled with a substance which is easily activated to discharge (as mercury vapor and argon filled into conventional fluorescent tube), and a plug 14 at an end of the tubular member 11 for power input. An opposite end of the tubular member 11 is provided with a conductive terminal 15 which is electrically connected to the plug 14 through a layer of conductive material 12 coated on the outer surface of the tubular member 11. Th e conductive material 12 may be made of transparent material such as vaporized tin halide, conductive printing ink or a conductive wire.

FIG. 4 illustrates an electrical circuit of the present invention. As shown, there is a porcelain step-up device 13 within the discharge tube 10 for meeting demands for different voltages in starting and actual operation. The power source 20 is electrically connected to the control IC 30 via a conductive wire La. A conductive wire Lb is connected between an output of the IC and the plug terminal 14 of the discharge tube 10. The conductive end 15 of the discharge tube 10 is connected to the power source 20 via a conductive wire Lc thereby providing a closed circuit.

The porcelain step-up device 13 is made of a piezoelectric material. The piezoelectric effect was discovered in the late nineteenth century, which states that compression of a crystal of quartz generates an electrostatic voltage across it, and conversely, application of an electric field may cause the crystal to expand or contract in certain directions. In brief, piezoelectric effect is the interaction of mechanical and electrical stress-strain variables in a medium. By means of this effect, the present invention converts strain into voltage so as to achieve the purpose of adjusting voltages. As shown in FIG. 3B, IN represents the input end of the porcelain piezoelectric plate 131, the vertical arrows the oscillation converted from the voltage, OUT the output end of the porcelain piezoelectric plate 131, and the horizontal arrows the voltage converted from oscillation. Hence, when a voltage is applied to the input end IN, there will be a different voltage at the output end OUT. The voltage applied to the output end OUT may be used for determining the resonance point of the resonance frequency. The voltage and frequency at the input end may be controlled by a chip such as required for searching oscillation frequency in voltage 12V to 110V or 220V. The relevant factors of the parameter voltage and current are comparatively easy to control. According to experiments, porcelain piezoelectric transformer is higher than 95% in efficiency. The conventional coil transformer only has an efficiency of 70–80%.

FIG. 3A illustrates the structure of the piezoelectric assembly 13. As shown, the piezoelectric assembly 13 includes a piezoelectric porcelain plate 131 provided with an input end having two terminals 134 and 135 for connecting with the input plug 14 of the discharge tube 14. The other end of the porcelain plate 131 is provided with a discharge electrode 133*a* so that the voltage applied to the input end will be transmitted to the discharge electrode 133*a* by piezoelectric effect thereby causing the discharge electrode 133 to emit free electrons and therefore activating the electrons to move at a high speed to discharge. At the beginning of discharge, the layer of conductive material 12 (or conductive wire) will be conducted between the input plug 14 and the conducting terminal 15. When the free electrons are sped up (i.e. after starting), the free electrons will move at a high speed between the electrodes 133*a* and 133*b* and the resistance is decreased. In the meantime, a lower voltage can be applied to keep on discharging.

From the above, it is understood that the present invention does not need a conventional starter and ballast. In brief, the present invention utilizes piezoelectric material to convert the voltage from the input end into starting and working voltages by piezoelectric effect to activate electrons to discharge and keep on discharging.

Turning now to FIG. 3A, the piezoelectric device [13] is fitted inside a glass tube 13 which the air has been taken out of, heat-treated and high pressure impact treated. The advantages of taking air out of the glass tube 135 are as follows: 1. the electrode will not corrode as it is isolated from the atmosphere; 2. good discharging effect; 3. low oscillation resistance; 4. no electromagnetic and discharge interference. In addition, the discharge electrodes 133*a* and 133*b* may be modified to adapt to different types of lamp tubes so as to obtain optimum discharging way. The preferred embodiment described herein is only an exemplary illustration of the present invention, but not intended to limit the scope of the present invention. The discharge electrodes in this preferred embodiment are a pair of fork-like members 133*a* and 133*b* arranged opposite to each other.

Conclusively, the power source 20 supplies a voltage of direct or alternating current through the conductive wire La to the control IC 30 which is responsible for providing a high voltage for starting and a relatively low voltage for working to an end of the discharge 10 via a conductive wire Lb and the discharge electrode 133*b* is connected to the power source 20 via a conductive wire Lc to form a closed circuit.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A piezoelectric porcelain step-up discharge tube comprising:

a vacuum tube having an inner surface coated with fluorescent material and filled with a substance which can be easily activated to discharge;

an input plug mounted on one end of said vacuum tube;

a conducting terminal arranged on another end of said vacuum tube;

a porcelain step-up device arranged within said vacuum tube and having an end electrically connected with said input plug and another end made of piezoelectric material for providing a discharging electrode for supplying a starting and working voltage; and a conductive material coated on an outer side of said vacuum tube and electrically connecting said input plug to said conducting terminal.

2. The piezoelectric porcelain step-up discharge tube as claimed in claim 1, wherein said porcelain step-up device is enclosed within a vacuum container.

3. The piezoelectric porcelain step-up discharge tube as claimed in claim 1, wherein said porcelain step-up member has two fork-like opposite discharge electrodes.

4. The piezoelectric porcelain step-up discharge tube as claimed in claim 1, wherein said conductive material is transparent.

5. The piezoelectric porcelain step-up discharge tube as claimed in claim 1, wherein said conductive material is made of tin halide.

6. The piezoelectric porcelain step-up discharge tube as claimed in claim 1, wherein said conductive material is made of conductive ink.

* * * * *